US006550489B1

(12) United States Patent
Yates

(10) Patent No.: US 6,550,489 B1
(45) Date of Patent: Apr. 22, 2003

(54) RECIRCULATING, LOW PRESSURE HOT WATER PARTS WASHING APPARATUS

(76) Inventor: James Patrick Yates, 6020 Chicory Knoll, Charleston, IL (US) 61920

( * ) Notice: Subject to any disclaimer, the term of this patent is extended or adjusted under 35 U.S.C. 154(b) by 119 days.

(21) Appl. No.: 09/618,319

(22) Filed: Jul. 18, 2000

(51) Int. Cl.[7] ..... B08B 3/00

(52) U.S. Cl. ..... 134/140; 134/153; 134/158; 134/200

(58) Field of Search ..... 134/140, 143, 134/153, 158, 200; 49/41; 312/305, 307

(56) References Cited

U.S. PATENT DOCUMENTS 3,645,791 A * 2/1972 Sadwith ..... 134/144
4,143,669 A * 3/1979 Minkin ..... 134/153
4,793,369 A * 12/1988 Robb et al. ..... 134/104.4
5,273,060 A * 12/1993 Hill et al. ..... 134/111
5,402,809 A * 4/1995 Smith ..... 134/129
5,640,981 A * 6/1997 Niemela et al. ..... 134/114
6,044,852 A * 4/2000 Epperson et al. ..... 134/108

* cited by examiner

*Primary Examiner*—Randy Gulakowski
*Assistant Examiner*—Joseph Perrin
(74) *Attorney, Agent, or Firm*—Kenneth Darnell

(57) ABSTRACT

A low pressure hot water parts washing apparatus recirculating a heated water/detergent solution and spraying same from a perforated manifold onto oily and dirt-laden parts carried by a rotary turntable. The turntable is peripherally mounted by bearings spaced about a conical solution reservoir tank to support parts without turntable tilting. The solution is drawn from the conical reservoir tank through apertures in a radiator tube housing heating elements, the elements being cleaned by a continual flow of solution passing thereover while efficiently heating the solution.

26 Claims, 7 Drawing Sheets

RECIRCULATING, LOW PRESSURE HOT WATER PARTS WASHING APPARATUS

BACKGROUND OF THE INVENTION

1. Field of the Invention

The invention relates generally to apparatus for washing parts to remove greases, oils and dirt, the invention particularly relating to low pressure apparatus which recirculates a water detergent solution at a relatively high temperature to spray the solution onto grime-laden parts moving on a perimeter-supported turntable mounted for rotation within the apparatus.

2. Description of the Prior Art

Apparatus intended for cleaning oils, greases and similar debris from parts such as parts removed from a vehicle engine or body when repairing the vehicle have long been known in the art. Although such apparatus are particularly useful in the washing of automotive parts, it is to be understood that parts of virtually any type which can become soiled especially by greases, oils and debris which mixes with such greases and oils can be washed with parts washing apparatus of widely varying description according to the art. Such prior apparatus typically use either an organic solvent as the washing liquid or a mixture of a detergent with water which forms an aqueous cleaning solution. Those parts washing apparatus utilizing organic solvents have become unusable in many states and municipalities due to environmental problems including disposing of the organic solvent itself Further, since such solvent washers cannot heat the solvent used for parts cleaning, the solvent must be sprayed at high pressures which can result in forcing debris of certain types into crevices and the like in certain types of parts with little prospect of removing such debris from the part. Parts washers are known which embody low pressure spraying of aqueous detergent solutions onto the parts to be cleaned, the parts being cleaned by a "flooding" process rather than by a "blasting" process.

While turntables have previously been used for mounting parts to be cleaned for rotary movement relative to spraying nozzles within a parts washer, the prior art has not envisioned the mounting of such a turntable about its periphery and supported by structure associated with the periphery of a conical solution reservoir, roller bearings mounted to the periphery of the conical reservoir engaging peripheral portions of the turntable to permit random location of parts, including heavy parts, on the turntable without concern for unbalancing of the turntable and thus tilting. Low pressure parts washers of the prior art typically require heating of the cleaning solution, a requirement which takes a substantial amount of time and energy. The present parts washing apparatus utilizes an extremely efficient heating element and perforated tube arrangement, the tube acting as a radiator with heated solution moving through the perforations into the conical solution tank. The heated solution is continuously recirculated and is brought in contact in each circulation cycle with heating elements disposed internally of the perforated tube. The heating elements are thus maintained in a clean condition.

Examples of the prior art include the parts washer disclosed in U.S. Pat. No. 5,640,981 by Niemela et al, this parts washer lacking the energy efficient heating element and radiator tube arrangement of the invention. Minkin, in U.S. Pat. No. 4,143,669, describes a parts washer having a higher powered liquid spray than does the present invention, such higher pressure sprays being used with organic solvents. In U.S. Pat. No. 5,385,159, Mead describes a parts washer having an upper tank open at the top with a sloped bottom portion which facilitates settling of sludge.

Accordingly, a need exists in the art for a parts washer which effectively and efficiently removes dirt in the form of caked greases, oils and debris and which uses a recirculating water and detergent solution sprayed onto soiled parts at low pressures and which is capable of cleaning soiled oily and greasy parts within a short period of exposure to the cleaning solution. The art has also suffered a long felt need for an aqueous cleaning solution parts washing apparatus whereby the solution may be heated to a desirable cleaning temperature rapidly and with energy efficiency.

SUMMARY OF THE INVENTION

The invention provides a low pressure hot water parts washing apparatus which recirculates an aqueous detergent solution between a conical solution reservoir disposed in a lowermost portion of the apparatus to a spray manifold located within an uppermost spray chamber wherein the hot solution is sprayed onto parts which are to be cleaned. The parts are placed on a perforated turntable which rotates at about three revolutions per minute relative to the spray manifold which is fixed in place within the spray chamber. The turntable is supported about its full periphery by roller bearings which are mounted about the periphery of the conical solution reservoir, it being possible to place heavy parts which are to be washed at any location of the turntable without concern for tilting of the turntable due to imbalance brought about by non-judicious placement of parts on the turntable. The turntable is driven through a sprocket and chain drive arrangement by an electric motor disposed externally of the spray chamber, the drive arrangement constituting a positive drive which avoids slippage as can occur in friction drive arrangements.

The spray chamber and the conical solution reservoir communicate with each other but are separated by means of removable perforated plate elements which effectively act as filters to prevent solid debris from collecting in the conical reservoir.

Heating elements effectively and efficiently heat the solution within the conical solution reservoir and are disposed within a tubular perforated radiator which protects the heating elements and which assists in efficient heating of the solution. Cleaning solution in its normal recirculating path through the apparatus moves from the reservoir through holes in the tubular radiator to pass by the heating elements and thus clean the heating elements on a continuous basis during washing operation. Heating element function and life are thus improved and increased by this particular cleaning solution recirculation arrangement.

A programmable control unit is preferably used to control the time of operation of the apparatus by turning the apparatus on and off at preselected times without the need for intervention after programming. An automatic oil skimmer is also operated by the controls, the controls further monitoring water temperature and water level. Still further, the controls monitor the lifecycles of internal components of the apparatus and indicate over time the time of operation of the apparatus. A sealing door carried by rollers movable on a track formed integrally with a lower portion of the apparatus is easily closed and opened by a user, a proximity switch being employed to indicate whether the door is open, operation of the apparatus being discontinued as long as the door is open.

The controls also operate a wastewater evaporation function on the command of a user, the temperature of the solution being increased on command to evaporate water from the cleaning solution, the residue of the solution simply being removed from the apparatus after water evaporation. The controls also operate automatic water fill functions and control a low-water shutoff sensor. A removable parts tree can be provided within the interior of the spray chamber for mounting of small parts during a cleaning cycle. Removable castors can be employed for rolling of the apparatus and the castors can be removed to open up channels at the lowermost portion of the apparatus which receive lift elements of a fork lift for efficient movement of the apparatus.

Accordingly, it is a primary object of the present invention to provide a low pressure, hot water parts washing apparatus which recirculates a heated water/detergent solution within the apparatus and sprays the solution onto oily and dirt-laden parts moving relative to a perforated spray manifold on a rotary turntable, the aqueous solution being sprayed at low pressure through perforations in the manifold at low pressure.

Another object of the invention is to provide a parts washing apparatus operable at low pressure wherein parts mounted on a rotary turntable are cleaned by a low pressure spray of aqueous cleaning solution, the turntable being mounted for rotation by roller bearings fixedly mounted about an upper periphery of a conical solution reservoir within which the cleaning solution is heated and to which the cleaning solution is drained after spraying.

It is yet another object of the invention to provide a parts washing apparatus which recirculates a heated water/detergent solution into contact with parts which are to be cleaned and a solution heating chamber within which the solution is heated by heating elements disposed within a perforated tube which acts as a radiator to facilitate heating of the solution and which allows cleaning solution to be drawn into the interior of the tube and into contacting relationship with the heating elements so that the heating elements are continuously subjected to the cleaning action of the recirculated cleaning solution.

Further objects and advantages of the invention will become more readily apparent in light of the following detailed description of the preferred embodiments.

DESCRIPTION OF THE PREFERRED EMBODIMENTS

Figure 1:
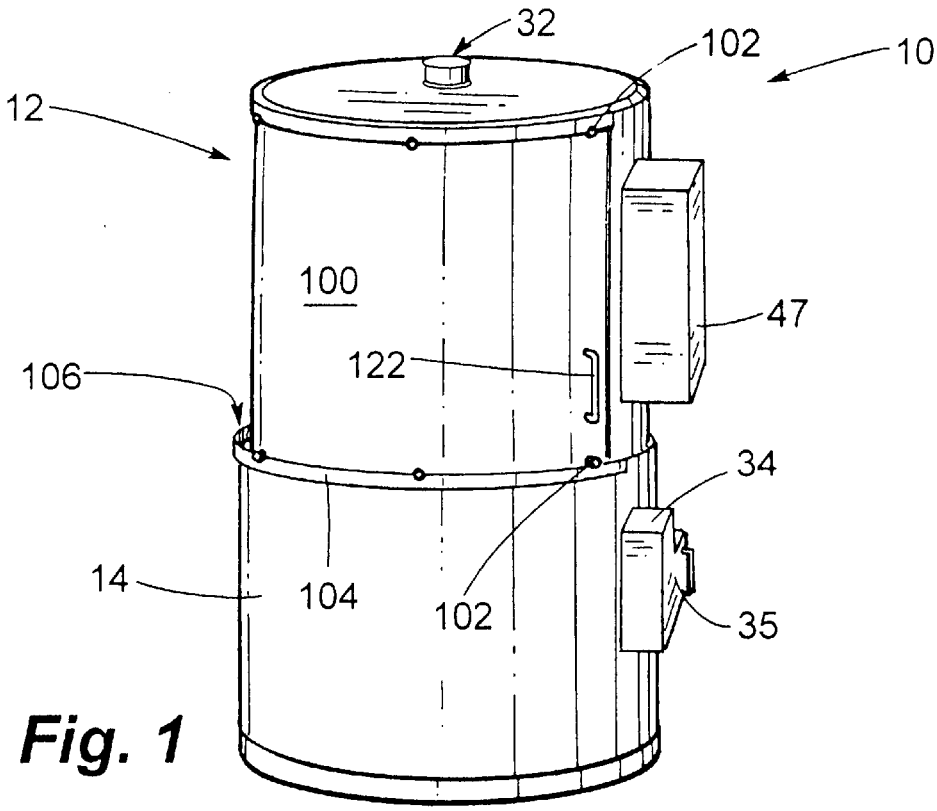
FIG. 1 is a perspective view of the parts washing apparatus of the invention shown in an operating condition with the door closed.
Figure 2:
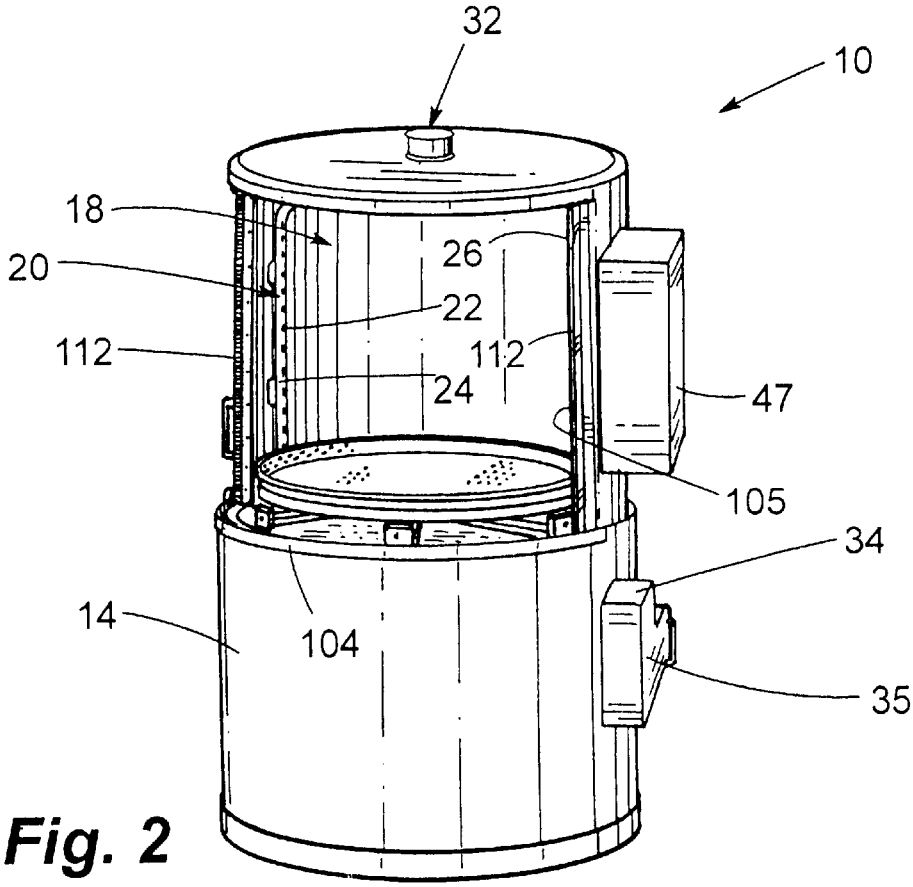
FIG. 2 is a perspective view of the parts washing apparatus of the invention shown with the door fully opened and without the screen elements in place.
Figure 3:
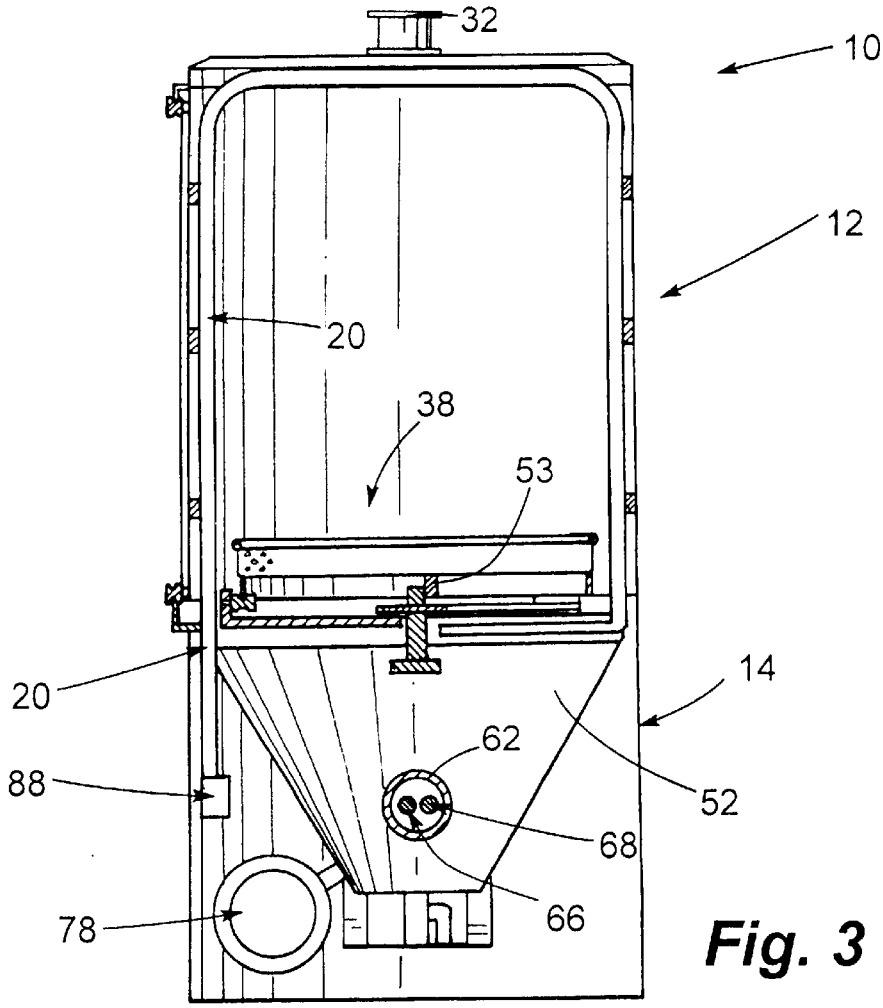
FIG. 3 is a sectional view of the apparatus of FIG. 2.
Figure 4:
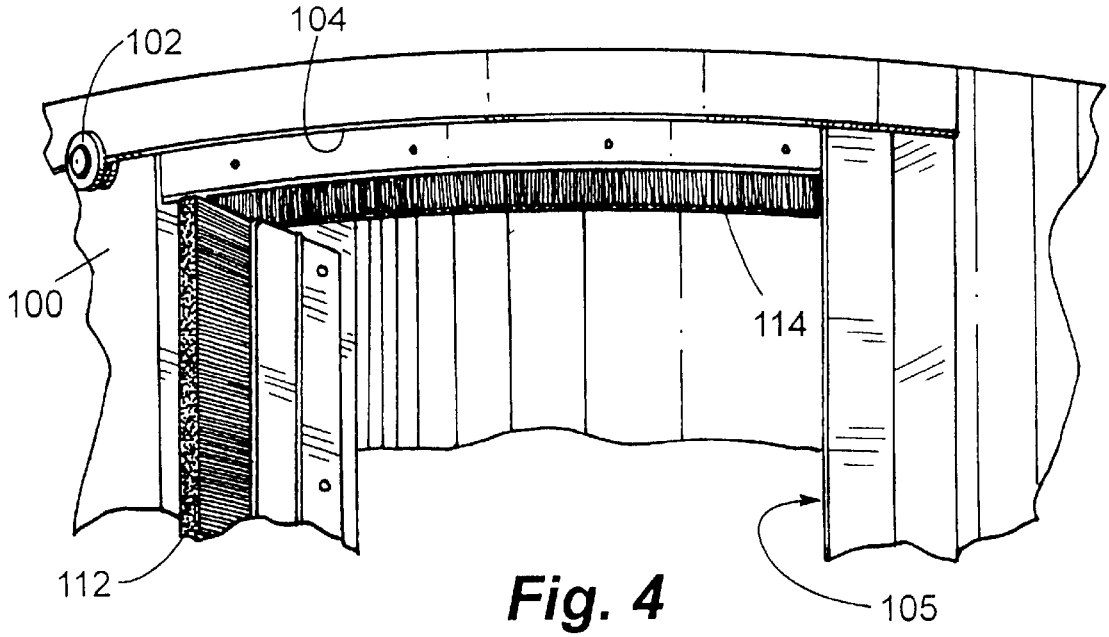
FIG. 4 is a detail view of sealing elements used to facilitate sealing of the door to the main body of the apparatus.
Figure 5:
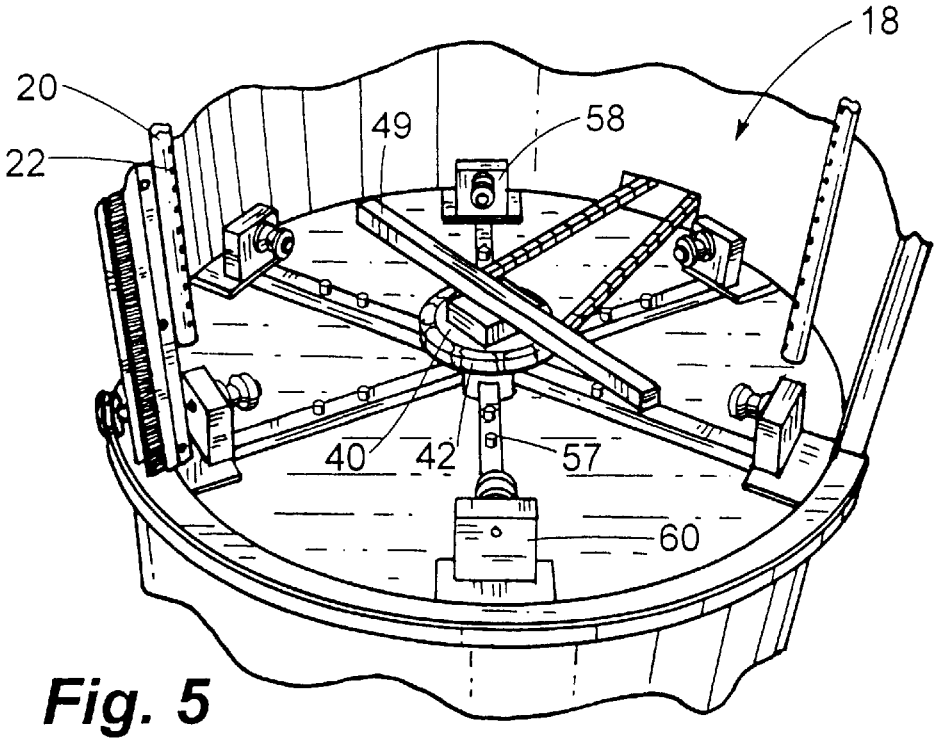
FIG. 5 is a perspective view of interior portions of a cleaning chamber of the apparatus shown without a turntable in place and without screen elements in place.
Figure 6:
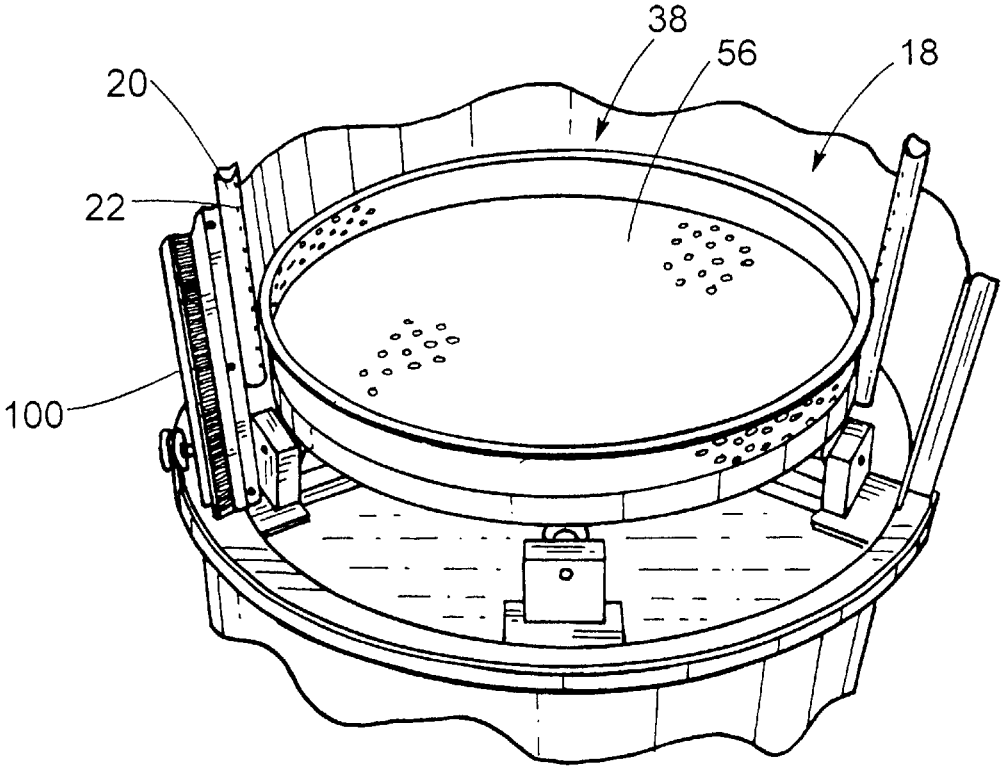
FIG. 6 is a perspective view of the cleaning chamber of the apparatus shown with the turntable in place but without screen elements in place.

Referring now to the drawings and particularly to FIGS. 1 and 2, a parts washing apparatus 10 configured according to the invention is seen to comprise an upper cabinet 12 and a lower cabinet 14, the upper cabinet 12 defining a cleaning chamber 18 as is seen in FIG. 2 and also in FIG. 6, the cleaning chamber 18 being substantially cylindrical on closure of door 100. In essence, the combination of the upper cabinet 12 and the door 100 causes the upper cabinet 12 to take a cylindrical conformation. The lower cabinet 14 essentially comprises a cylindrical body portion of the apparatus 10 which is slightly greater in diameter than the diameter of the upper cabinet 12. The lower cabinet 14 essentially comprises a housing for apparatus sub-systems including plumbing and electrical sub-systems which are controlled as will be described hereinafter to cause a heated aqueous cleaning solution to be sprayed at low pressure onto parts (not shown) which are to be cleaned of oils, greases, etc., within the cleaning chamber 18. An access panel (not shown) covers an opening (not shown) in the lower cabinet 14, the access panel in a conventional manner being removable in order to gain access to components of the apparatus 10 housed by the lower cabinet 14.

The upper cabinet 12 and the lower cabinet 14, along with most of the other metal components comprising the apparatus 10 are formed of stainless steel in order to provide a structure of particularly high quality which provides an increased operating lifetime especially with use of high temperature water and detergent cleaning solutions. The use of stainless steel to fabricate the apparatus 10 or at least major portions of it and particularly those portions which come in contact with hot cleaning solution provides an effective useable lifetime for the apparatus 10 which is substantially greater than is to be expected with ordinary carbon steel or similar materials most often used in the construction of parts washing apparatus. The cabinets 12, 14 are typically formed of fourteen gauge stainless steel and can be formed with cleaning chambers of differing sizes and parts capacities of differing weight and cleaning chamber dimensions.

It is to be noted that the apparatus 10 is conveniently sized in order to provide a work surface height, that is, the height of the opening in the upper cabinet 12, so that an individual loading parts into the apparatus 10 loads at waist level in order to reduce the possibility of back strain.

A manifold 20 having perforations 22 along its length is seen in FIG. 2 inter alia to be formed of vertical legs 24, 26, an upper horizontal bight portion 28 and a horizontally disposed terminal portion 30. The perforations 22 extend substantially along the full length of the manifold 20 and are positioned thereon in order to direct a spray of a cleaning solution into central portions of the interior of the cleaning chamber 18. The vertical leg 24 of the manifold 20 is connected as will be described hereinafter to plumbing apparatus housed within the lower cabinet 14, cleaning liquid being forced under relatively low pressure such as about 11 psi through the manifold 20 and out of the perforations 22 into the interior of the cleaning chamber 18. The manifold 20 is maintained in a fixed position within the cleaning chamber 18. The terminal portion 30 of the manifold 20 is disposed in a position which is below the parts which are to be cleaned as will be seen from description yet to be provided.

The upper cabinet 12 is further provided with a vent 32 which allows escape of heated water vapor and steam, the vent 32 acting in a manner similar to the function of a pressure relief valve although low pressures are employed within the cleaning chamber 18.

A conventional oil skimmer apparatus 34 including a fall-level indicator (not shown) is mounted to the apparatus 10 at a convenient location, the skimmer preferably being of the plate-type which is conventional in the art and which includes a motor (not shown) which drives a plate to skim oil from cleaning solution passed through the skimmer 34 an appropriate time after shut down of the cleaning function of the apparatus 10. Essentially, the apparatus 10 is shut down after a day's operation and the oil skimmer 34 is caused to operate beginning about one hour after apparatus shutdown. The skimmer 34 can be provided with a reservoir at 35 into which relatively large sludge-like particles of hydrocarbons and the like can be deposited.

Figure 7:
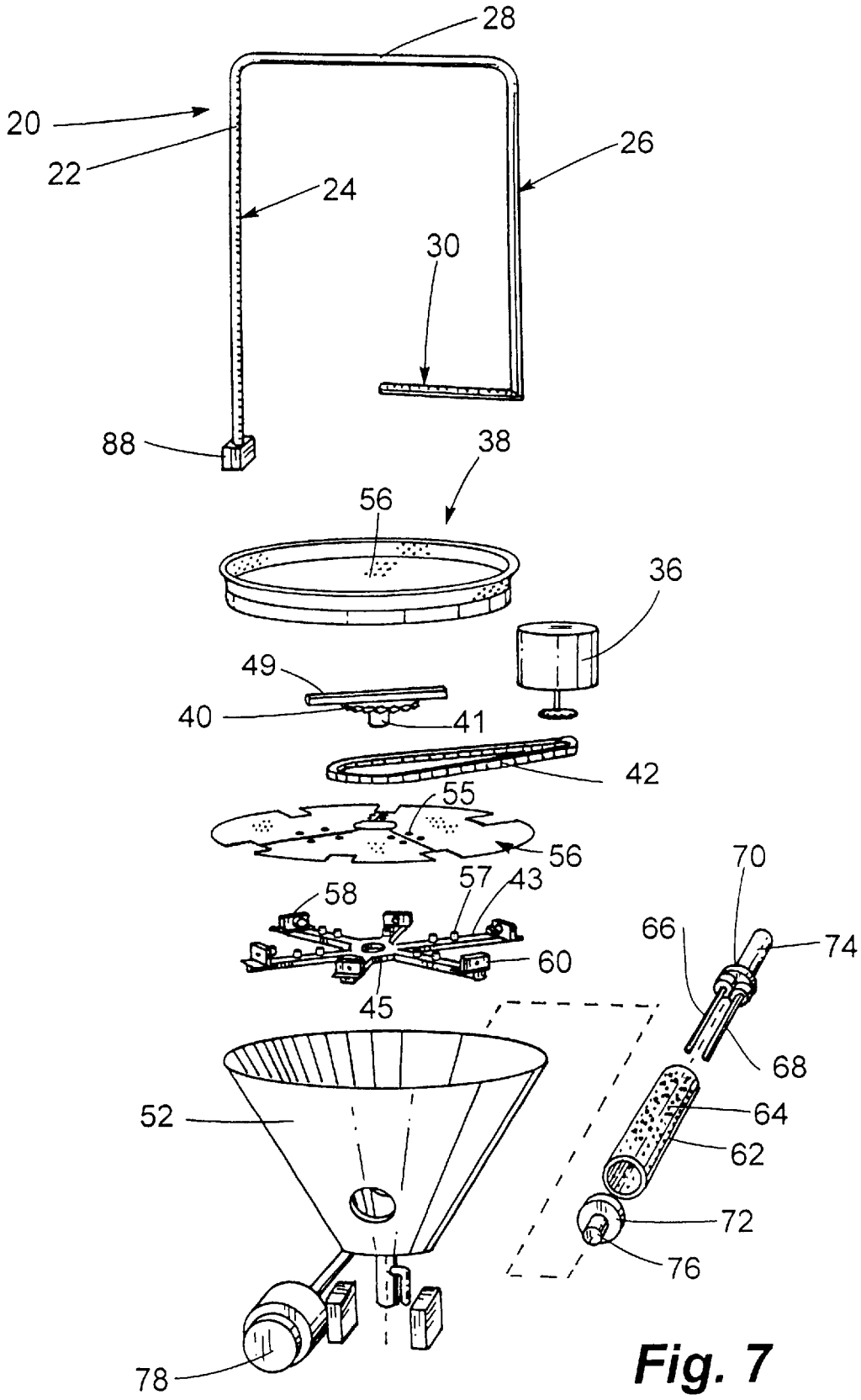
FIG. 7 is a partially exploded view of the apparatus with the exterior shell or cabinet removed.
Figure 8:
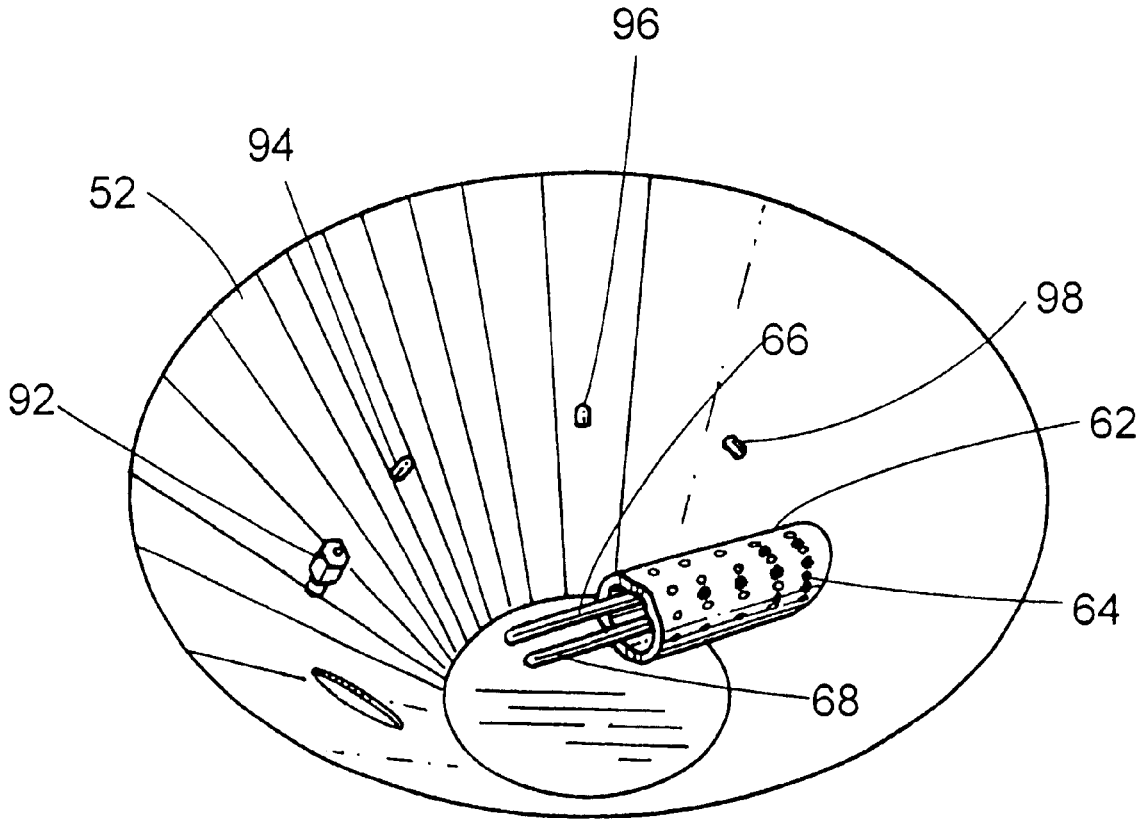
FIG. 8 is a perspective view of a conical cleaning solution reservoir tank without peripheral shoulder portions including a reservoir tube and heating elements shown removed from the apparatus and partially cut-away.

A motor 36 mounted to the upper cabinet 12 exteriorly of the apparatus 10 is covered by a hood 47, the motor 36 best being seen in FIG. 7 and acting to drive a sprocket 40 mounted at a lower central portion of the cleaning chamber 18 by a stub shaft 41 which is in turn mounted for rotation by structural spokes 43 extending in regular fashion from the perimeter of conical cleaning solution reservoir tank 52. The spokes 43 are substantially flat, elongated elements which connect to a cylindrical hub 45 through which the stub shaft 41 extends and is thereby mounted. The stub shaft 41 mounts a toothed sprocket 40 immediately above the hub 45, the sprocket 40 being driven by a chain 42 which extends through an opening (not shown) in a side wall of the upper cabinet 12 and into mechanical contact with the motor 36, the motor 36 driving the sprocket 40 by means of the chain 42. The opening through which the chain 42 extends is covered by the hood 47. The sprocket 40 is provided with a diametrically disposed bar element 49. On rotation of the sprocket 40, the bar element 49 is caused to rotate at approximately 3 to 6 revolutions per minute, surfaces of the bar element 49 coming into corresponding contact with camming pads 53 mounted to the underside of a turntable 38, thereby to rotate the turntable 38.

It is to be understood that the turntable 38 can be utilized to mount parts which are to be washed. A conventional parts tree (not shown) can be mounted to the turntable in order to hold parts which can best be washed through the use of such ancillary apparatus as contemplated. The turntable 38 can be formed of an upper ring 44, a lower ring 46 with expanded mesh side walls 48 joining the rings 44, 46 about opposing peripheral undersurfaces thereof, a bottom 50 of the turntable 38 being fixed to the lower ring 46 in a conventional manner. It is to be understood that turntables such as the turntable 38 exist which are of conventional design although it is to be understood that modifications may be made to the turntable 38 which facilitates functioning with other structure to cause the apparatus to be operable, such as the camming pads 53.

A conical cleaning solution reservoir tank 52 is seen in FIG. 2 inter alia to be conically shaped with the putative apex of the cone being disposed downwardly within the apparatus 10, a circular periphery of the base of the conical tank 52 being upwardly disposed and being essentially turned outwardly about its periphery and welded to upper peripheral portions of the lower cabinet 14. The connection between the lower cabinet 14 and the conical tank 52 is caused to have substantial strength since this combination of structure is intended to support the turntable 38 and the hundreds of pounds of parts which are to be placed on the turntable 38 for washing.

In order to prevent unbalancing of the turntable 38 such as can occur in other parts washing apparatus, the turntable 38 is mounted in the present apparatus 10 for rotation on bearings 58 which contact periphery 54 of the lower ring 46 comprising the turntable 38. The bearings 58 are mounted for rotation by bearing mounts 60 which are fixed to peripheral portions of the conical tank 52. The spokes 43 mounting the hub 45 and the stub shaft 41 which in turn mounts the sprocket 40 and the turntable 38 are seen to extend from the mount 60 to the hub 45, the spokes 43 being fixed at each end respectively to said mount 60 and to the said hub 45. The bearings 58 positively support the turntable 38 for rotary motion within the cleaning chamber 18 without tilting of the turntable 38 such as can occur with turntables of prior parts washing apparatus due to injudicious placement of parts which are to be cleaned on these prior art turntables. Turntables supported at their center by means of a shaft only are subject to tilting of the turntable which usually causes the apparatus to shut down or sustain damage. The present parts washing apparatus 10 in use functions properly regardless of the location on the turntable 38 occupied by the parts which are to be cleaned.

Figure 10:
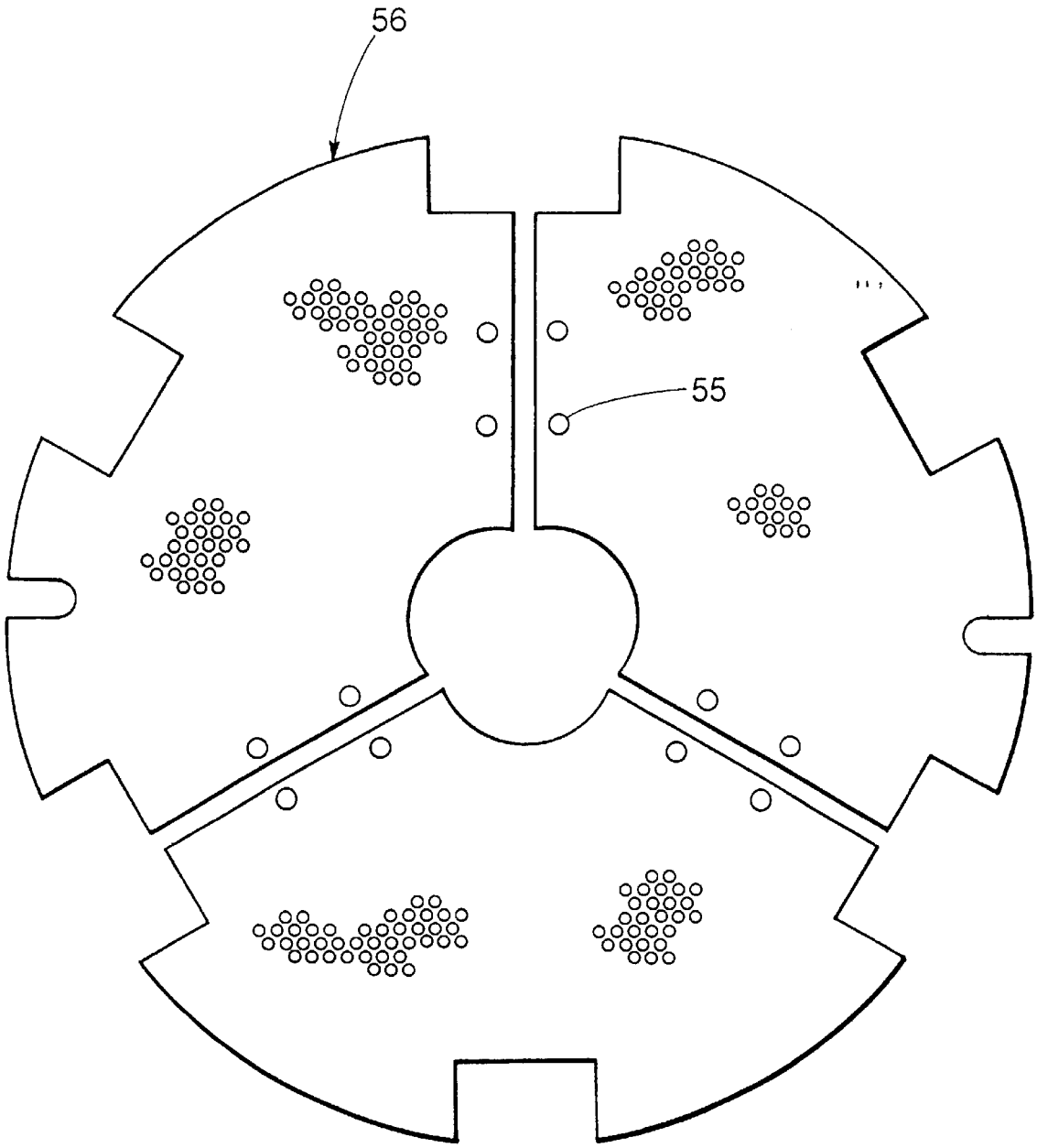

Perforated screen elements 56, seen best in FIG. 10, are placed over the spokes 43 and have apertures 55 which mate with pins 57 which extend upwardly from upper surfaces of each of the spokes 43. The pins 57 received within the apertures 55 of the screen elements 56 cause said screened elements 56 to stay in their proper location, thereby to form a continuous screen between the cleaning chamber 18 and the interior of the conical reservoir tank 52. The screen or filter formed by the perforated screen elements 56 prevent rough debris and other unwanted materials from falling into the interior of the reservoir tank 52. Further, at initial operation of the apparatus 10, detergent is placed for dissolution onto the screen elements 56.

The conical cleaning solution reservoir tank 52, which is best seen in FIGS. 5 through 8, is seen to be substantially conical in conformation as has been indicated previously, the conical body of the tank 52 having a radiator tube 62 extending through aligned openings formed in the tank 52 and extending outwardly of the tank 52 at each end of the tube 62. The radiator tube 62 is closed at either end by respective end plates 70 and 72, the end plates 70, 72 and the ends of the radiator tube 62 extending externally of the conical reservoir tank 52 and being flush fit and effectively sealed at the openings mentioned above but not expressly shown which are formed in the tank 52 for receipt of the tube 62 therethrough. The radiator tube 62 is provided with a plurality of holes 64 through which cleaning solution passes from the interior of the tank 52, the holes 64 being formed only in that portion of the tube 62 lying within the confines of the tank 52. Heating elements 66 and 68 are mounted by the end plate 70, the heating elements 66, 68 essentially being conventional hot water heating elements, said elements being conventionally fitted to the end plate 70 at which location electrical connections 74 connect with the heating elements 66, 68. The heating elements 66, 68 are preferably 4500 watt heating elements and act to efficiently and effectively heat cleaning solution within the tank 52 with substantial energy efficiency. Cleaning solution sprayed through the manifold 20 within the cleaning chamber 18 moves downwardly by gravity into the conical tank 52 and through the holes 64 in the radiator tube 62 to contact the heating elements 66, 68 and thereby continuously clean said heating elements 66, 68 during operation of the parts washing apparatus 10. Essentially, the only path which the cleaning solution can follow for recirculation is through the radiator tube 62 and into contact with the heating elements 66, 68. The radiator tube 62 further enhances energy efficiency by heating of the cleaning solution within the conical tank 52 by radiation of heat to the solution from the radiator tube 62.

Heated cleaning solution is drawn from that end of the radiator tube 62 which is sealed by the end plate 72, the end plate 72 having a fitting 76 mounted thereto at one end and to one end of a hose 82 which extends between the fitting 76 and pump 78 which is driven by motor 80 in a direct-drive manner which is conventional in the art. The pump 78 thus draws heated cleaning solution from the tank 52 on the suction side of said pump 78. Cleaning solution then goes through the pressure side of the pump 78 which has a fitting 84 disposed between the pump 78 and a hose 86 which connects to a fitting 88 formed on an end of the manifold 20 such that the cleaning solution on the pressure side of the pump 78 is forced upwardly into the manifold and sprayed through the manifold at a relatively low pressure.

The combination of the radiator tube 62 with the conical tank 52 has particular advantages which are not readily obvious. Shaping the solution-holding tank as a cone can be appreciated in its own right as providing several advantages. For example, the quantity of solution employed is less with the conical tank than with a cylindrical tank having the same base and height. With a smaller quantity of solution to heat, energy efficiencies are inherently present. Further, the lowermost portion of the tank 52 takes the shape of the apex of a cone since the conical tank 52 is inverted. For that reason, the tank 52 can be cleaned much more easily than can a cylindrical tank, a tank shaped as a rectangular solid or any other known tank. A temperature sensor 61 placed on a wall surface of the tank 52 at a location just below or near the projected lower portions of the tube 62 can provide an indication of the need to clean the tank 52. Once sludge gathers in the bottom of the tank 52 to a level covering the sensor 61, the sensor 61 will not read a temperature which is as high as the temperature of the solution in upper portions of the tank 52, thereby indicating that the quantity of sludge materials present in the tank 51 has reached a point at least up to and possibly contacting lower portions of the tube 62 depending on the location of the sensor 61. Temperature difference measurements can be taken relative to a comparison of the temperature read by the sensor 61 and by any sensor detecting the temperature of the solution.

The holes 64 formed in the radiator tube 62 are conveniently taken to be 11–64ths of an inch in diameter although the hole diameter can vary. However, it is to be understood that a relatively small hole diameter is desirable in order to prevent a vortex flow of the solution within the tank 52 during recirculation of the solution. In practice, the number of the holes 64 increase from the pump intake side of the tube 62 toward the other end of the tube 62. Thus, there will typically be at least twice as many of the holes 64 at the end opposite the pump intake side of the tube 62 as are present at the pump intake side. Such an arrangement of the holes 64 permits a pulling of the solution by the pump 78 from all portions of the tank 52 at least above the tube 62 rather than the creation of one or more vortex flow patterns which would occur with a few large holes. In a vortex flow pattern, only a portion of the solution would be recirculated. The holes 64 are also seen to be formed only over the "top" half to two-thirds of the tube 62 such that the lower portions of the tube 62 are not perforated. This selective perforation of the tube 62 minimizes the tendency to draw sludge present in the lower portion of the tank 52 up into the tube 62 especially on start-up of the apparatus when the pump 78 is first activated.

The shape of the tank 52 further provides for heating efficiency, heat being transferred to the solution through the radiating effect of the tube 62 upwardly into the solution with heat flow curving outwardly at top portions of the solution toward upper walls of the tank 52. Thus, a heat flow is created around the tank in a pattern whereby upward flow of heat first occurs, the flow cascading outwardly and then downwardly to efficiently heat the solution present throughout the upper portions of the tank 52 and particularly including the solution about the upper periphery of the tank 52. Heated water moves in this flow pattern to be increasingly heated as the flow continues and to thus reach a desired solution temperature rapidly and with substantial energy efficiency.

Temperature sensors 92, 94, 96 are mounted in a wall of the tank 52 and connect to appropriate controls which are to be described hereinafter. First sensor 92 senses the temperature of the cleaning solution within a temperature range of 170° to 180° F. for normal cleaning operation, the sensor 92 through appropriate controls shutting off the heating elements 66, 68 once water temperature attains the desired temperature. The second sensor 94 is caused to operate in a mode to cause a wastewater evaporation function, the sensor 94 causing the heating elements 66, 68 to heat the cleaning solution to a temperature of up to 210 to 212° F. so that the cleaning solution evaporates leaving a residue which can be cleaned from the lower portion of the conical tank 52. The parts washing function cannot operate when the apparatus 10 is controlled through the sensor 94. The third sensor 96 allows heating of the cleaning solution to 140° F., an indication of this temperature allowing a user to realize that detergent may be added to the apparatus 10 without producing a foaming problem. Conventional electrical connections connect the sensors 92, 94 and 96 to appropriate controls for selection of the necessary function.

A low water level control sensor 98 is mounted to a wall of the conical tank 52 for indication of a minimum water level within the tank 52 at which parts washing can commence. Since powder detergents are approximately 90 to 95% inert, that is, fillers such as soda ash and the like, these detergents will not dissolve below a temperature of 140° F. and would drop to the bottom of the tank 52 in the event that inappropriate operating temperature, that is a detergent solubilizing temperature, had not been reached prior to distribution of the detergent within the interior of the cleaning chamber 18. The powder detergent is simply thrown over the screen elements 56 when temperature of the water or cleaning solution within the tank 52 reaches a temperature of 140° F. The low level control sensor 98 is a part of a conventional water level control apparatus utilized to provide the desired function within the apparatus 10.

Figure 9:
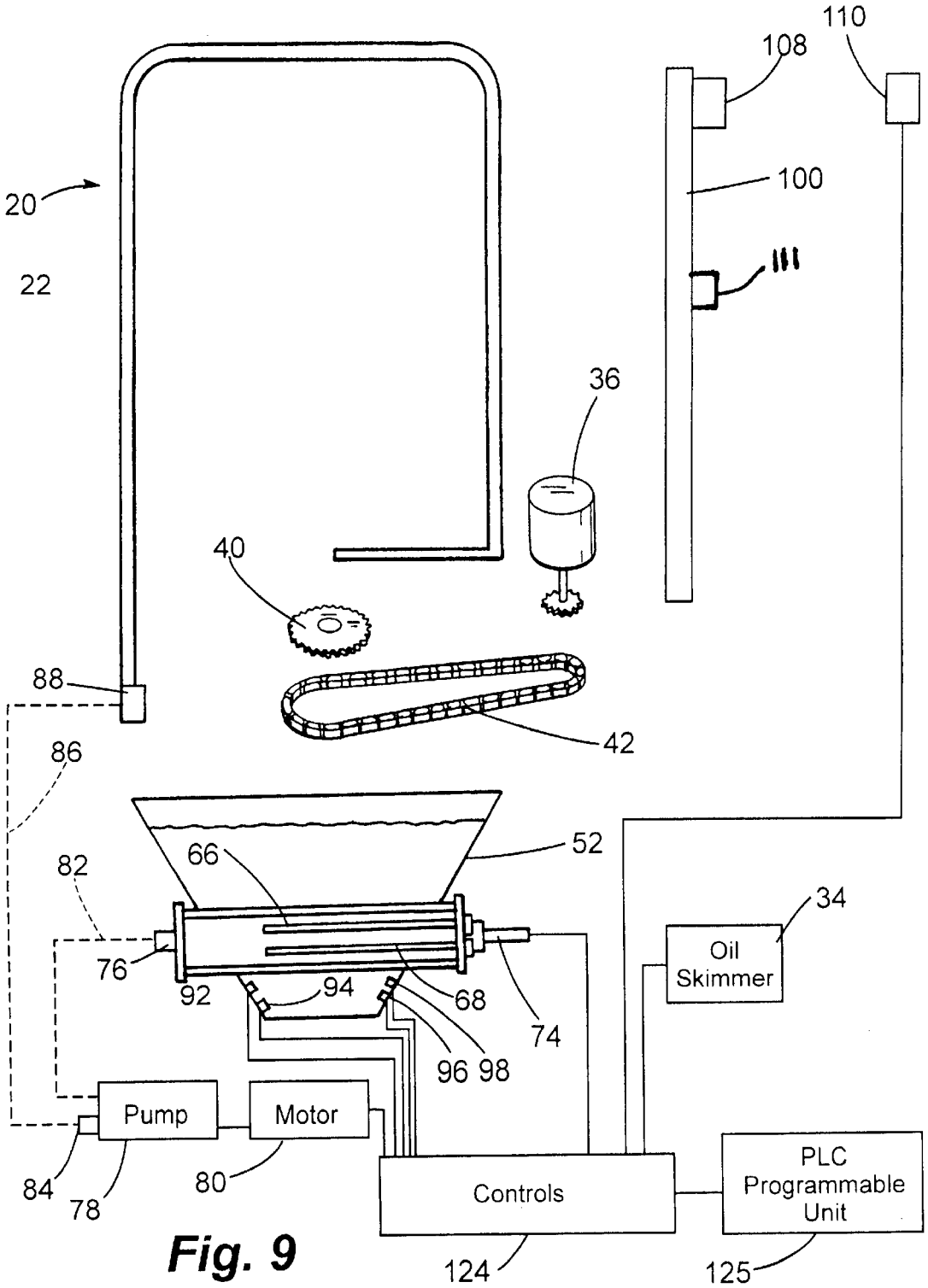
FIG. 9 is a schematic of plumbing and electrical subsystems including connections to a control panel and to each other; and, FIG. 10 is a plan view of the screen elements which are to be disposed between the washing chamber of the apparatus and the conical cleaning solution reservoir tank, the screen elements comprising a filter.

The door 100 of the upper cabinet 12 is arcuate in shape in the manner in which a portion of the periphery of a cylinder is cut from the cylinder, the door 100 on full closure essentially forming a cylinder with remaining portions of the upper cabinet 12. The door 100 moves on rollers 102 attached to upper and lower horizontal side edges of the door 100, the rollers 102 moving on tracklike elements which comprise lips 104 of channels 106 which are formed along horizontal edge portions of the door opening of the upper cabinet 12. A channel 105 which is disposed vertically at said door opening receives the forward edge of the door 104 therewithin and seals the door 100 by means of a brush seal 112. The door 100 is seen to be provided with a plate element 108 (seen only in FIG. 9) which contacts a proximity switch 110 mounted to the upper cabinet at the door opening so that it can be determined that the door 100 is fully moved in place to cover the door opening and thus close and seal the apparatus 10. A door interlock 111 can further be provided to prevent opening of the door 100 immediately after cleaning of parts. The interlock 111 can take the form of a variety of conventional interlock mechanisms such as a solenoid-operated pin lock which prevents opening of the door 100 until interior temperatures have fallen to a level whereby the door 100 can be opened without subjecting an operator to steam and vapors at potentially dangerous temperatures. The interlock may be timed or may be responsive to temperatures within the interior of the upper cabinet 12. Brush seals 114 are also respectively located horizontal along edges of the door 100 in order to provide sealing functions. The forward edge of the door 100 fits within the U-shaped channel 105 which is formed along the door opening in a vertical sense to receive the forward edge of the door 100. The door 100 is conveniently provided with a handle 122 to allow manual opening and closing of the door 100. A control box 124 is conveniently mounted to a side wall of the apparatus 10 externally thereof, the control box having a seven day/twenty-four hour programmable timer and a Siemens PLC programming unit 125 (see FIG. 9) which allows programming of controls to turn the apparatus 10 on and off, fill the apparatus 10 with water, monitor the life cycles of all components of the apparatus 10, monitor and cause to function the turntable motor 36, the motor of the oil skimmer 34, heating elements 66, 68, etc. and to indicate the length of time that the apparatus 10 is operated over a given period of time. Controls (not shown) inside the control box 124 are programmable to produce a desired functioning of the apparatus 10. It is to be understood, however, that the functioning of the apparatus 10 can be embodied in a hardwired arrangement (not shown) to produce all desired functions necessary for operation of the apparatus 10.

The apparatus 10 can be seen to be provided with casters (not shown) mounted to undersurfaces of the lower cabinet 14. The casters can be used to roll the apparatus 10 easily to desired locations. Channels (not shown) can be formed in a lowermost surface of the lower cabinet 14 to provide entryways for lifting of the apparatus 10 such as by a fork-lift truck or the like.

Certain features of the apparatus 10 described herein should be emphasized. The positive drive arrangement formed by the sprocket 40 and the chain 42 driven by the motor 36 is utilized to prevent slippage inherent in many turntable drive arrangements of the prior art. In the present invention, slippage does not occur during drive of the turntable 38.

Further, it is desirable to maintain the heating elements 66, 68 in as clean a condition as possible. Accordingly, the heating elements 66, 68 are placed inside the radiator tube 62 whereby the heated cleaning solution is recirculated past and in contact with the heating elements 66, 68 so that said heating elements are continuously cleaned during operation of the apparatus 10.

Further, the parts washing apparatus 10 functions without the necessity for tying down small parts or the like which could be dislodged from a parts tree or from the turntable 38, cleaning solution being sprayed through the manifold 20 at low pressure of approximately 11 psi so that parts to be cleaned and particularly including small parts to be cleaned, are not dislodged from the turntable 38 on subjection thereof to a flow of cleaning liquid thereagainst.

It is therefore to be seen that the apparatus 10 of the invention can be configured in ways other than as explicitly described herein, the scope of the invention being defined by the scope of the recitations of the appended claims.

What is claimed is:

1. A parts washing apparatus recirculating a high temperature solution of water and detergent as a cleaning solution sprayed at low pressure against parts to be washed within a cleaning chamber, the parts being disposed on a turntable, the improvement comprising:

a cleaning solution reservoir tank surmounted by the cleaning chamber and having a peripheral portion;

a cabinet housing the tank, the peripheral portion of the tank being fixed to an upper peripheral portion of the cabinet forming a strengthened juncture therebetween;

bearing means fixed to the tank and the cabinet and being spaced thereabout for supporting the turntable about its periphery for rotary motion within the cleaning chamber;

first means for supporting the turntable centrally thereof; and, second means extending between the bearing means and the first supporting means for supporting the turntable at locations between the bearing means and the first supporting means.

2. In the improvement of claim 1 wherein the bearing means comprise a plurality of roller bearings mounted one each to one end of a plurality of plates fixed to the periphery of the tank.

3. In the improvement of claim 2 wherein the first supporting means comprise a hub.

4. In the improvement of claim 3 wherein the second supporting means comprise a plurality of radially disposed arms joined at outer ends one each to each one of the plates and at inner ends to the hub.

5. In the improvement of claim 1 wherein the tank is substantially conical in conformation.

6. In the improvement of claim 1 wherein the cabinet is substantially cylindrical in conformation.

7. In the improvement of claim 1 and further comprising means for rotating the turntable.

8. In the improvement of claim 7 wherein the rotating means comprise a sprocket and a chain driven by a motor, the sprocket having a bar element mounted to an upper face thereof the bar element having a camming pad at each end, the turntable having camming pads spaced diametrically across from each other and fixed to a bottom of the turntable, the camming pads of the bar element contacting and pushing against the camming pads on the turntable on rotation of the sprocket and thus the bar element to cause the turntable to rotate within the cleaning chamber.

9. In the improvement of claim 1 and further comprising a screen mounted between the cleaning chamber and the tank.

10. In the improvement of claim 1 and further comprising a door, tracks carried by the apparatus, and rollers carried by the door for engagement with the tracks, the door moving between open and closed positions by virtue of movement of the rollers along the track.

11. In the improvement of claim 10 and further comprising a proximity switch mounted to the apparatus in a position opposing a plate carried by the door when the door is closed, the proximity switch indicating closure of the door.

12. In the improvement of claim 1 and further comprising a radiator tube extending through the reservoir tank and heating elements disposed within the tube, the tube being formed with a plurality of apertures through which cleaning solution is drawn from the tank and into contact with the heating elements for heating of the cleaning solution and cleaning of the heating elements.

13. In the improvement of claim 12 wherein lower portions of the tube are unperforated.

14. In the improvement of claim 12 and further comprising means disposed at one end of the tube for drawing solution from the tank and into the tube for recirculation between the tank and the cleaning chamber, the tube having a greater number of apertures formed progressively in the tube from said one end toward and to the other end of the tube.

15. In the improvement of claim 14 wherein the drawing means comprise a pump disposed at one end of the radiator tube.

16. A parts washing apparatus recirculating a high temperature solution of water and detergent as a cleaning solution sprayed at low pressure against parts to be washed within a cleaning chamber contained within a cabinet, the parts being disposed on a turntable for subjection to cleaning solution sprayed thereon, the improvement comprising:

a cleaning solution reservoir tank surmounted by the cleaning chamber;

bearing means carried by the cabinet for supporting the turntable about its periphery for rotary motion within the cleaning chamber, the bearing means comprising a plurality of bearings mounted one each to each one of a plurality of plates mounted within the cabinet;

first means carried within the cabinet for supporting the turntable centrally thereof, the first supporting means comprising a hub; and, second means extending between the bearing means and the first supporting means for supporting the turntable at locations between the bearing means and the first supporting means, the second supporting means comprising a plurality of radially disposed arms joined at outer-ends one each to each one of the plates and at inner ends to the hub.

17. In the improvement of claim 16 wherein the tank is substantially conical in conformation.

18. In the improvement of claim 16 wherein the cabinet is substantially cylindrical in conformation.

19. In the improvement of claim 16 and further comprising means for rotating the turntable, the rotating means comprising a sprocket and a chain driven by a motor, the sprocket having a bar element mounted to an upper face thereof, the bar element having a camming pad at each end, the turntable having camming pads spaced diametrically across from each other and fixed to a bottom of the turntable, the camming pads of the bar element contacting and pushing against the camming pads on the turntable on rotation of the sprocket and thus the bar element to cause the turntable to rotate within the cleaning chamber.

20. In the improvement of claim 16 and further comprising a screen mounted between the cleaning chamber and the tank.

21. In the improvement of claim 16 wherein the bearings comprise roller bearings.

22. A parts washing apparatus recirculating a high temperature solution of water and detergent as a cleaning solution sprayed at low pressure against parts to be washed within a cleaning chamber, the parts being disposed on a turntable, the improvement comprising means for rotating the turntable, the rotating means comprising a sprocket and a chain driven by a motor, the sprocket having a bar element mounted to an upper face thereof, the bar element having a camming pad at each end, the turntable having camming pads spaced diametrically across from each other and affixed to a bottom of the turntable, the camming pads of the bar element contacting and pushing against the camming pads on the turntable on rotation of the sprocket and thus the bar element to cause the turntable to rotate within the cleaning chamber.

23. A parts washing apparatus recirculating a high temperature solution of water and detergent as a cleaning solution sprayed at low pressure against parts to be washed within a cleaning chamber, the parts being disposed on a turntable, the improvement comprising:

a cleaning solution reservoir tank surmounted by the cleaning chamber; and, a radiator tube extending through the reservoir tank and heating elements disposed within the tube, the tube being formed with a plurality of apertures through which cleaning solution is drawn from the tank and into contact with the heating elements for heating of the cleaning solution and cleaning of the heating elements.

24. In the improvement of claim 23 wherein lower portions of the tube are unperforated.

25. In the improvement of claim 23 and further comprising means disposed at one end of the tube for drawing solution from the tank and into the tube for recirculation between the reservoir tank and the cleaning chamber, the tube having a greater number of apertures formed progressively therein from said one end toward and to the other end of the tube.

26. In the improvement of claim 25 wherein the drawing means comprises a pump.

* * * * *